US007147291B1

(12) United States Patent
Greiner

(10) Patent No.: US 7,147,291 B1
(45) Date of Patent: Dec. 12, 2006

(54) JEWELRY CHEST AND BOX WITH SLIDABLE FEATURES

(76) Inventor: Lori Greiner, 1301 Dearborn Pkwy., Suite 402, Chicago, IL (US) 60610

( * ) Notice: Subject to any disclaimer, the term of this patent is extended or adjusted under 35 U.S.C. 154(b) by 0 days.

(21) Appl. No.: 10/360,289

(22) Filed: Feb. 7, 2003

Related U.S. Application Data

(63) Continuation of application No. 09/952,378, filed on Sep. 13, 2001, now abandoned.

(51) Int. Cl.
*A47B 81/00* (2006.01)

(52) U.S. Cl. ..... 312/294; 312/321.5

(58) Field of Classification Search ..... 312/227, 312/208, 209, 310, 321.5, 300, 120, 123, 312/245, 294, 330.1, 351; 206/6.1
See application file for complete search history.

(56) References Cited

U.S. PATENT DOCUMENTS 1,600,830 A 9/1926 Lewis
1,610,146 A * 12/1926 Panzer ..... 190/109
2,513,150 A 6/1950 Davis
2,663,608 A 12/1953 Schauer
2,739,697 A 3/1956 Kuddes
3,078,133 A 2/1963 Schauer
3,089,745 A * 5/1963 Postula et al. ..... 312/324
3,639,022 A 2/1972 Elmo
3,813,138 A 5/1974 Doohan
3,876,271 A 4/1975 Skirlock
3,930,702 A 1/1976 Pichowicz
4,120,549 A 10/1978 Bureau
4,239,308 A 12/1980 Bradley
4,371,077 A 2/1983 Solitt et al.
4,396,121 A 8/1983 Lemmon
4,771,206 A 9/1988 Taylor
4,811,996 A 3/1989 Hansson
4,850,658 A 7/1989 Sandor
4,854,656 A 8/1989 O'Keefe
D303,999 S * 10/1989 Hansson ..... D3/297
4,936,463 A 6/1990 Tiramani
4,984,854 A 1/1991 DeLavallade
D315,460 S * 3/1991 Sorce, Jr. ..... D6/469
5,108,162 A 4/1992 Lund
5,117,971 A 6/1992 Fisher
5,261,529 A 11/1993 Holland
5,411,139 A 5/1995 Victory
D361,430 S 8/1995 Mohundro
5,484,092 A 1/1996 Cheney
5,511,873 A 4/1996 Mech
5,551,772 A * 9/1996 Keffer ..... 312/114

(Continued)

FOREIGN PATENT DOCUMENTS

DE 19924969 A1 12/2000

(Continued)

*Primary Examiner*—James O. Hansen
(74) *Attorney, Agent, or Firm*—Fredrikson & Byron, P.A

(57) ABSTRACT

A jewelry chest and box for storing jewelry having a plurality of compartments to store jewelry items of various configurations. The jewelry chest includes pivoting cabinets having earring stands that are slidably received in the cabinets. Drawers are located under the cabinets and have various compartments to hold jewelry items such as bracelets, rings and pins. The jewelry box has a bottom tray and an upper tray each having divided compartments. The upper tray is preferably slidably mounted in the box and preferably can be removed from the box. The upper tray has a projection to assist a user in sliding the tray or removing the tray from the box.

9 Claims, 9 Drawing Sheets

U.S. PATENT DOCUMENTS

| | | | | | |
|---|---|---|---|---|---|
| 5,558,418 | A | | 9/1996 | Lambright et al. | |
| 5,603,558 | A | * | 2/1997 | Zimmer | 312/290 |
| 5,603,559 | A | * | 2/1997 | Yemini | 312/333 |
| 5,685,624 | A | | 11/1997 | Lee | |
| 5,690,401 | A | | 11/1997 | Franklin | |
| 5,692,605 | A | | 12/1997 | Lai | |
| 5,762,184 | A | * | 6/1998 | Greiner | 206/6.1 |
| 6,045,202 | A | | 4/2000 | Simon | |

FOREIGN PATENT DOCUMENTS

| | | | |
|---|---|---|---|
| FR | 940540 | | 12/1948 |
| GB | 287249 | | 3/1928 |
| GB | 2112630 | * | 7/1983 |
| GB | 2205225 | A | 12/1988 |
| GB | 2 273 649 | A | 6/1994 |
| GB | 2345630 | A | 7/2000 |
| JP | 2000-197530 | | 7/2000 |
| WO | WO 99/00005 | | 1/1999 |

* cited by examiner

JEWELRY CHEST AND BOX WITH SLIDABLE FEATURES

RELATED APPLICATION

The present application is a continuation of U.S. patent application Ser. No. 09/952,378 entitled "Jewelry Chest and Box with Slidable Features" filed on Sep. 13, 2001 now abandoned, incorporated herein by reference.

FIELD OF THE INVENTION

The present invention relates to a jewelry chest and box with unique slidable features. While several different kinds of jewelry chests and boxes are known, there is a need for a jewelry chest and box that are convenient to use and allow a user to easily view and select jewelry.

BACKGROUND OF THE INVENTION

One type of a known jewelry holder is in the form of a container with relatively high sides and back walls and a top that is hinged to the back wall to permit access into the container. Earring stands are fixed to the bottom of the container. A particular problem with this type of jewelry holder is that it is very difficult to insert and remove the jewelry from the stands because the side walls and hinged top limit the amount of space available.

Yet another type of jewelry holder proposes racks that slide into a box-like container having a single open side. Again, a problem with this type of jewelry holder is that because the racks are designed as an integral part of the box-like container when the racks are removed from the container, the racks cannot be placed on a horizontal surface without falling over. In addition, because there is only one open side, access to the jewelry located inside the container is limited.

U.S. Pat. No. 5,762,184, invented by the present inventor and hereby incorporated by reference discloses a jewelry holder with a plurality of movable earring stands that are positioned on a base. The base is in the form of a box with an open front that slidably receives a drawer. The top of the base is provided with a plurality of grooves that slidably receive the earring stands. The stands include a pair of supports joined by a substantially horizontal cross-piece that has at least one aperture sized to receive a post or stem of an earring. The stands include a base that is sized to slidably fit within the grooves in the base. Alternatively, clip-on earrings may be directly clipped onto the crosspiece. The drawer is limited in the amount of jewelry it can store.

Thus, it is desirable to provide a jewelry chest that can hold a large amount of jewelry in an organized fashion that allows a user to have direct and easy access to the jewelry contained therein. In addition, it is desirable to provide a jewelry chest and box that makes visual inspection of the items contained therein easy. In addition, it is desirable to provide a jewelry chest and box that groups like items together.

DETAILED DESCRIPTION OF THE PREFERRED EMBODIMENTS

Figure 1:
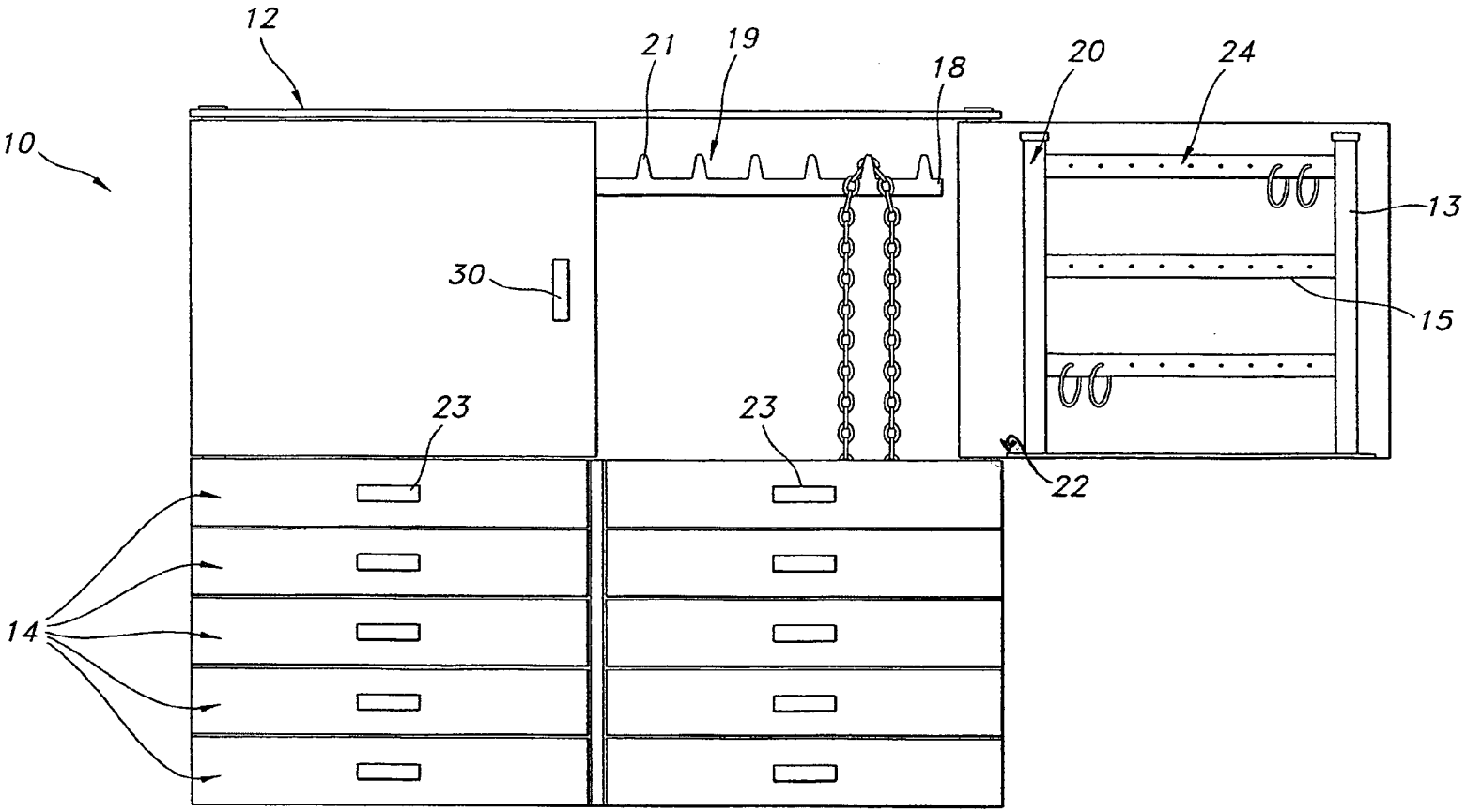
FIG. 1 is a front elevational view of a jewelry chest according to a first preferred embodiment of the present invention.
Figure 2:
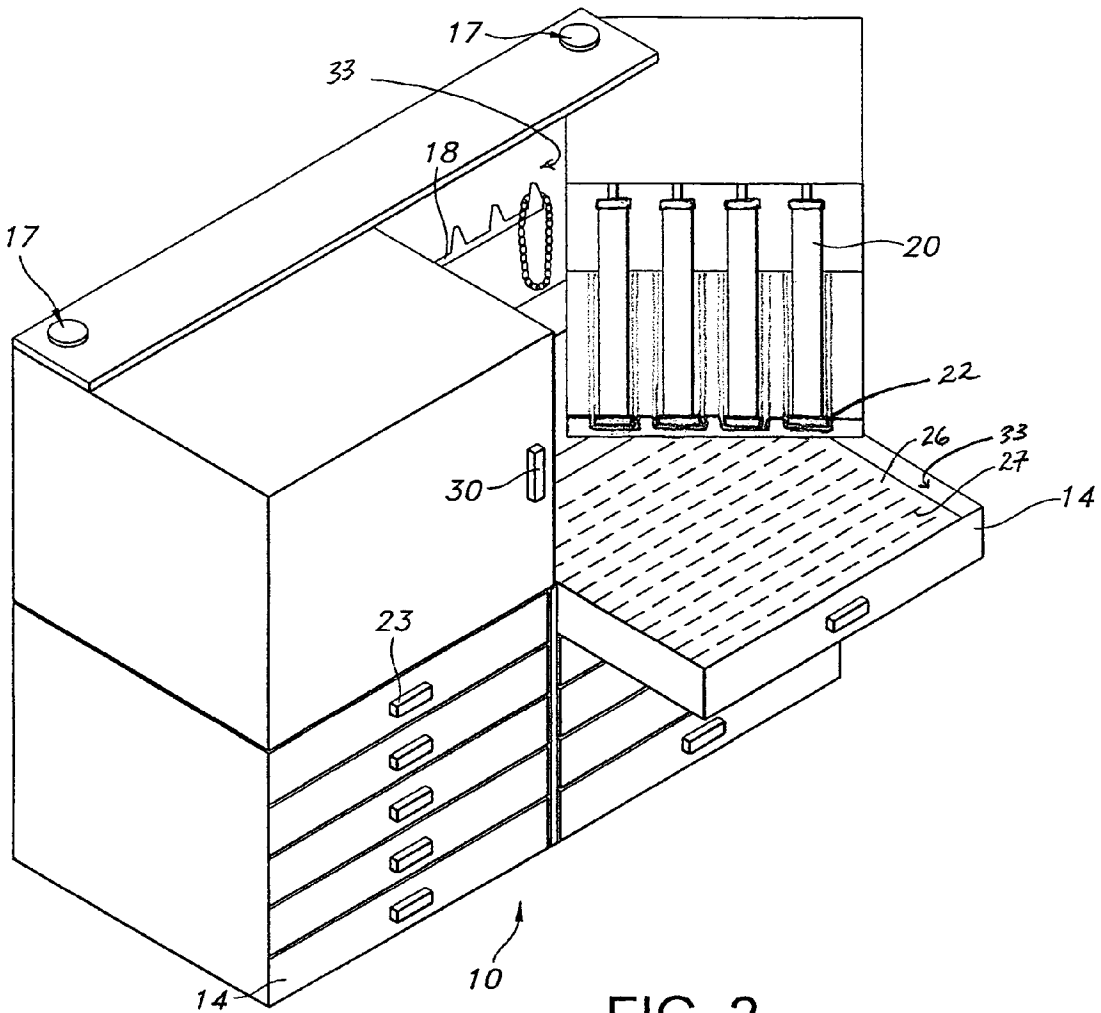
FIG. 2 is a perspective view of the jewelry chest shown in FIG. 1 with the door and drawer pulled out of the chest.

FIG. 1 is a front elevational view of a jewelry chest according to a first preferred embodiment of the invention. The jewelry chest 10 has two doors 12, and a plurality of drawers 14 located underneath the two doors. The jewelry chest 10 is shown with one of the doors 12 swung open. The jewelry chest 10 has a back wall 19 with a necklace rack 18 secured thereto. The necklace rack 18 has a plurality of hooks 21 on which necklaces can be hung. The doors 12 each form a cabinet as can be seen in FIG. 2 in which a plurality of sliding earring stands 20 are mounted. More particularly, the sliding earring stands 20 can be slid out of the cabinet formed in the door 12. The sliding earring stands are seen from one end in FIG. 2 and from one side in FIG. 1. Now referring to FIG. 1 and to FIG. 2, the sliding earring stands 20 are mounted in grooves/tracks 22 formed in the bottom of the door. U.S. Pat. No. 5,762,184 entitled "Jewelry Holder with at Least One Moveable Stand", by the present inventor which is incorporated herein by reference, discloses sliding earring stands that are the same as those incorporated into the doors. The sliding earring stands 20 each have a plurality of crosspieces 24 formed extending between pillars 13. Each cross piece has a plurality of holes 15 in which pierced earrings can be mounted. In addition, clip on earrings can be mounted directly to the crosspiece 24. The sliding earring stands, when removed from the cabinet, are self-supporting, in other words the earring stands can stand on their own on a relatively flat surface when removed from the grooves or tracks 22 in the door 12.

The drawers 14 have handles 23 which allow the user to slide a drawer 14 in and out of the chest 10. The number of drawers 14 provided in the chest 10 can vary and the present invention is not limited to the particular embodiment shown. In addition, the chest 10 may be provided in which no drawers are present and the chest consists of the doors 12 with the earring stands.

FIG. 2 is a perspective view of the jewelry chest 10 shown in FIG. 1 with one of the front doors 12 open and one drawer 14 pulled out of the chest. From this view the ends of the plurality of sliding earring stands 20 can be seen mounted in the door 12. The doors 12 are rotatably secured in the housing of the chest by hinges 17. A drawer 14 is shown open. Storage compartments such as a ring section 26 can be placed in the drawer. Alternatively, the storage compartments may be formed as an integral part of the drawer and not changeable by the user. The ring section 26 is preferably a soft, foam-like material in which slits 27 are formed. The slits 27 accommodate rings so that they can be mounted therein. The other drawers 14 may also hold rings or they may have compartments to hold larger items such as bracelets, brooches and necklaces. The drawers 14 can be customized by forming the storage compartments as stand alone units which can be dropped into a drawer according to a user's needs and preferences.

Figure 4:
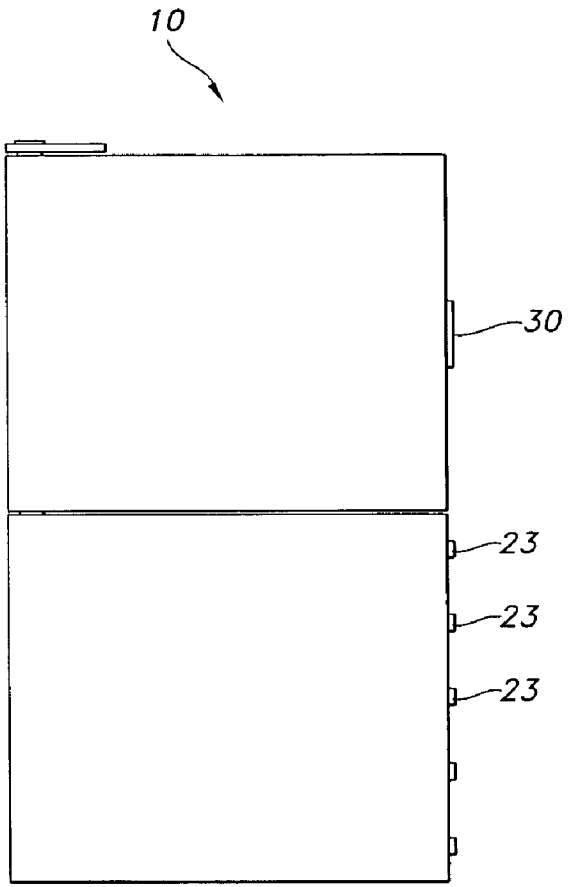
FIG. 4 is a side view of the jewelry chest shown in FIG. 1.
Figure 3:
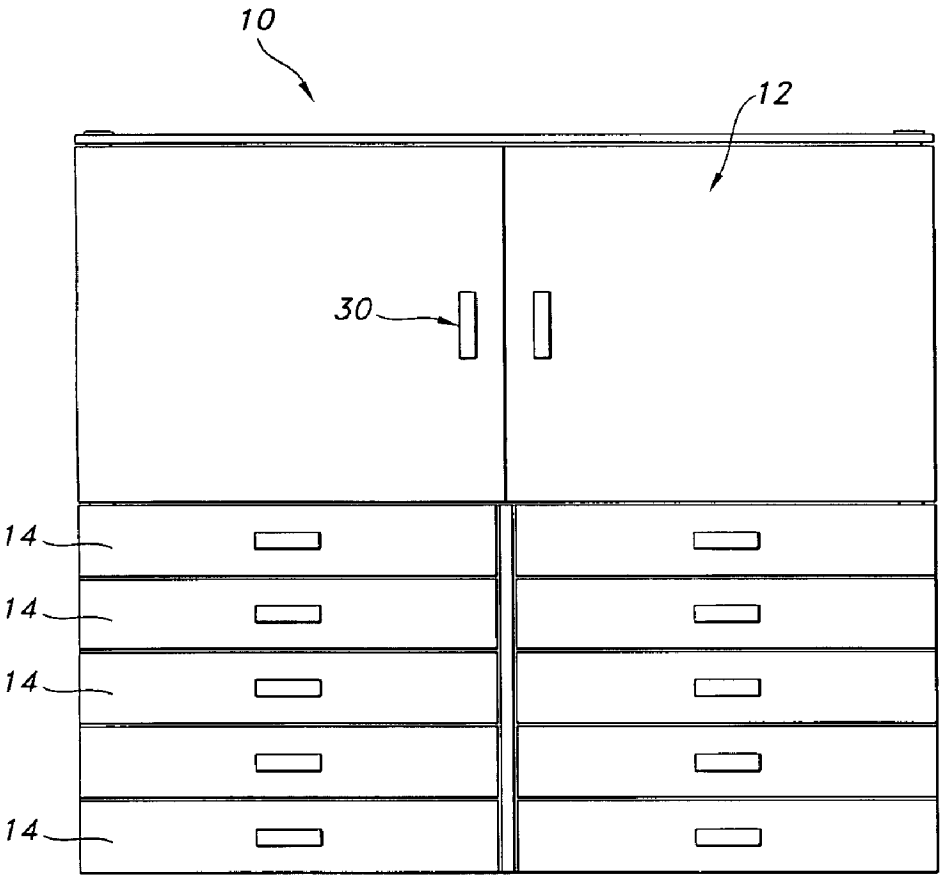
FIG. 3 is a front elevational view of the jewelry chest shown in FIG. 1 closed.

FIG. 3 is a front elevational view of the jewelry chest 10 shown in FIG. 1 with all the doors and drawers closed. Handles 30 are formed on the doors to swing open or pivot the doors. FIG. 4 is a side view of the jewelry chest 10 shown in FIG. 1.

The walls and floors of the compartments of the jewelry chest are preferably lined with an anti-tarnish cloth 33, such as Glendale Polish Cloth, which is commercially available from Fifield Inc. of Hingham, Mass., or Silversmith's Cloth available from W.J. Hagerty and Sons, South Bend, Ind. The anti-tarnish cloth 33 allows the jewelry to be placed in the chest 10 while reducing the risk of tarnish to the jewelry items.

In a preferred embodiment, the jewelry chest is formed of plastic and is about one foot wide, one foot high and about nine inches deep. Of course, the preferred embodiment of the chest is not limited in size and other dimensions may be used depending on the quantity of jewelry to be held. Alternatively, the chest can be made of various materials such as acrylic, polystyrene, polypropylene and wood.

Figure 5:
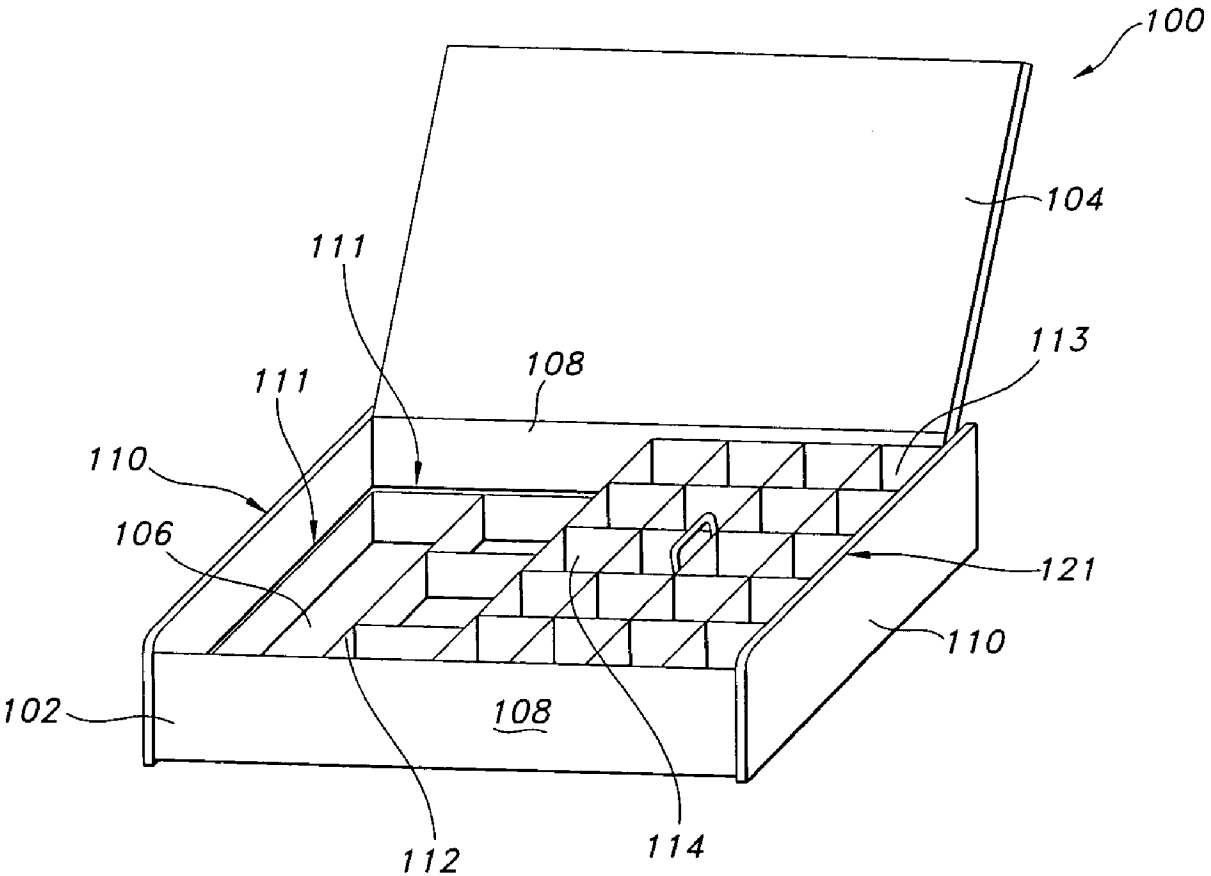
FIG. 5 is a perspective view of a jewelry box according to a preferred embodiment of the present invention.
Figure 6:
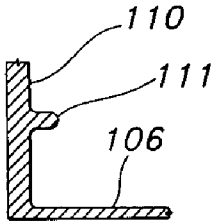
FIG. 6 is a partial cross-sectional view of the side wall of the jewelry box shown in FIG. 5 according to a preferred embodiment of the present invention.
Figure 7:
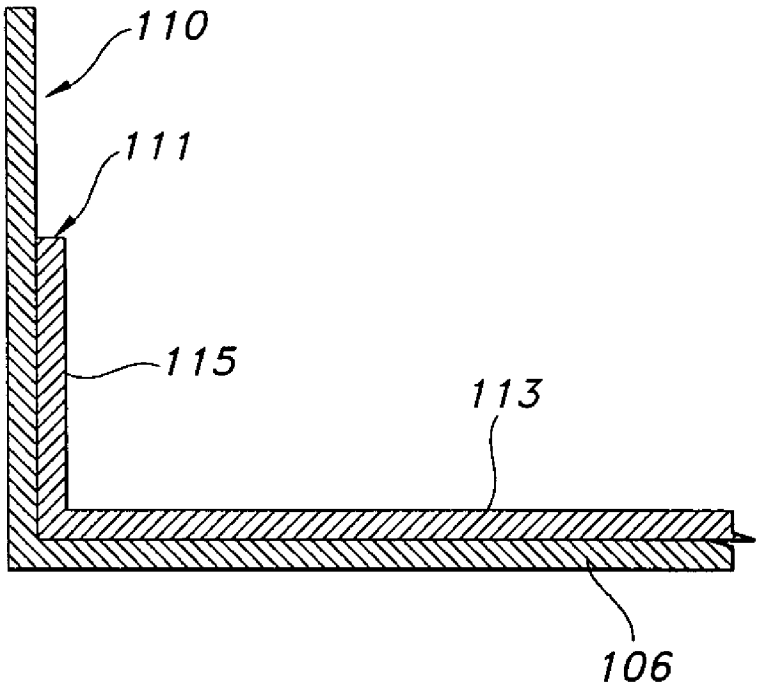
FIG. 7 is a partial cross-sectional view of the side wall of the jewelry box shown in FIG. 5 according to a preferred embodiment of the present invention.

FIG. 5 is a jewelry box 100 according to a preferred embodiment of the present invention. The jewelry box 100 includes a base 102 and a lid 104. The base is formed by a bottom 106, a front and a back side 108 and a left and a right side 110. Formed along the front and back sides 108 and left and right sides 110 is a rim 111. FIG. 6 is a partial cross-sectional view of the side wall of the jewelry box shown in FIG. 5 according to a preferred embodiment of the invention. It can be seen that the rim 111 projects from the side wall 110 and is of sufficient size and strength to hold a sliding earring tray 114. FIG. 7 is a partial cross-sectional view of the side wall of the jewelry box shown in FIG. 5 according to another preferred embodiment of the present invention. In the preferred embodiment, the rim 111 is formed by an inner box 113 located in the base 102. The inner box 113 has walls 115 that extend partially up the front, back, left and right walls 108, 110, respectively.

Located within the base 102 is a first sliding tray 112 and a top sliding tray 114. Alternatively, there may be only one top sliding tray 114. The bottom sliding tray 112 has a plurality of compartments as will be described with respect to FIG. 8. The top sliding tray 114 has a plurality of compartments 113 that are designed to hold small jewelry items such as earrings. The top sliding tray 114 is supported by the rim 111 formed along the front and back walls 108 and left and right side walls 110. The top sliding tray 114 can be pushed along the rim so that it slides over the bottom sliding tray 112. In addition the top sliding tray can be removed from the jewelry box 100 altogether. Preferably, the top sliding tray 114 is provided with a projection 121 that can be used by the user to slide the top tray 114 or remove it from the chest. The projection 121 may be foldable so as to not interfere with closing the lid 104. Alternatively the projection would not protrude above the top of the side walls 110 so as to not interfere with the lid 104.

If a bottom tray 112 is provided, it may also be provided with a similar projection (not shown). Because of space limitations, if a bottom tray is provided with a projection, the projection may be foldable so that when it is not needed, it can be folded out of the way of the top tray 114. Alternatively, the projection of the bottom tray 112 may be configured so that it does not protrude above the side walls of the bottom tray 112, to allow the top tray 114 to slide above the bottom tray 112.

Figure 10:
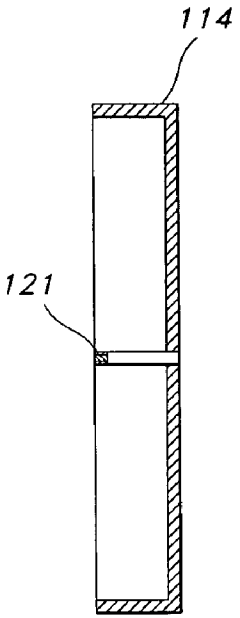
FIG. 10 is a cross-sectional view of the drawer shown in FIG. 9 taken along lines 10—10.
Figure 9:
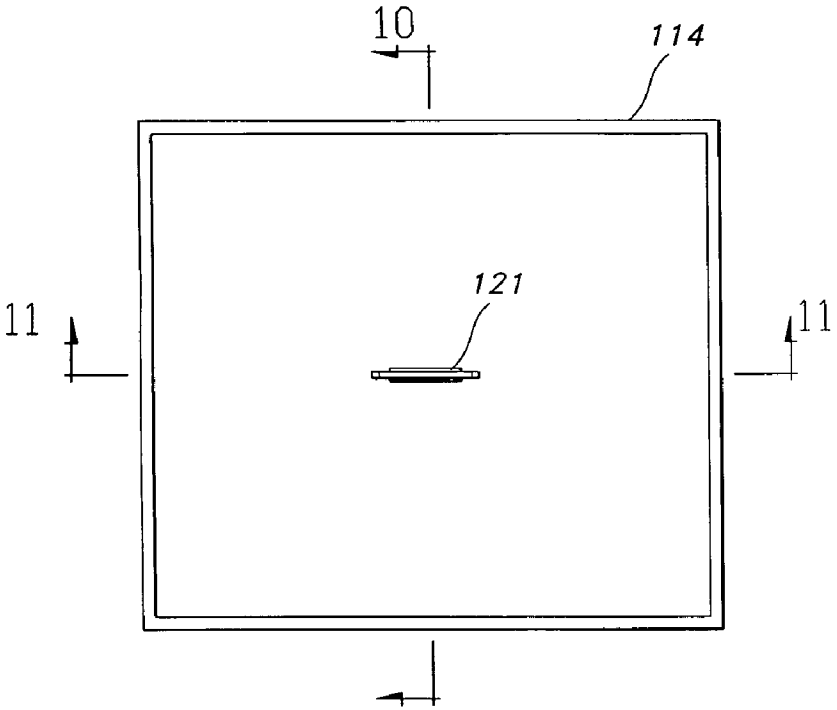
FIG. 9 is a top view of the top sliding drawer.
Figure 11:
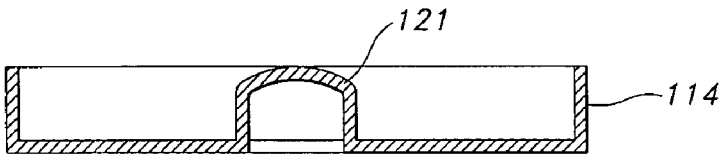
FIG. 11 is a cross-sectional view of the drawer shown in FIG. 9, taken along line 11—11.

FIG. 9 is a top view of a top sliding tray according to a preferred embodiment of the present invention. For simplicity purposes, individual storage compartments are not illustrated. FIGS. 10 and 11 are cross-sectional views of the tray shown in FIG. 9 taken along lines 10—10 and 11—11, respectively. Preferably, the projection 121 is located in the center of the top tray, although it does not have to be located in the center. The projection 121 is preferably in the shape of a loop as can be seen in FIG. 11. The projection is preferably made of the same material as the sliding top tray 114. It will be appreciated that the projection 121 may have other shapes besides a loop. For example, it can be a handle of a knob or any shape that allows a user the ability to grasp the projection 121.

Figure 8:
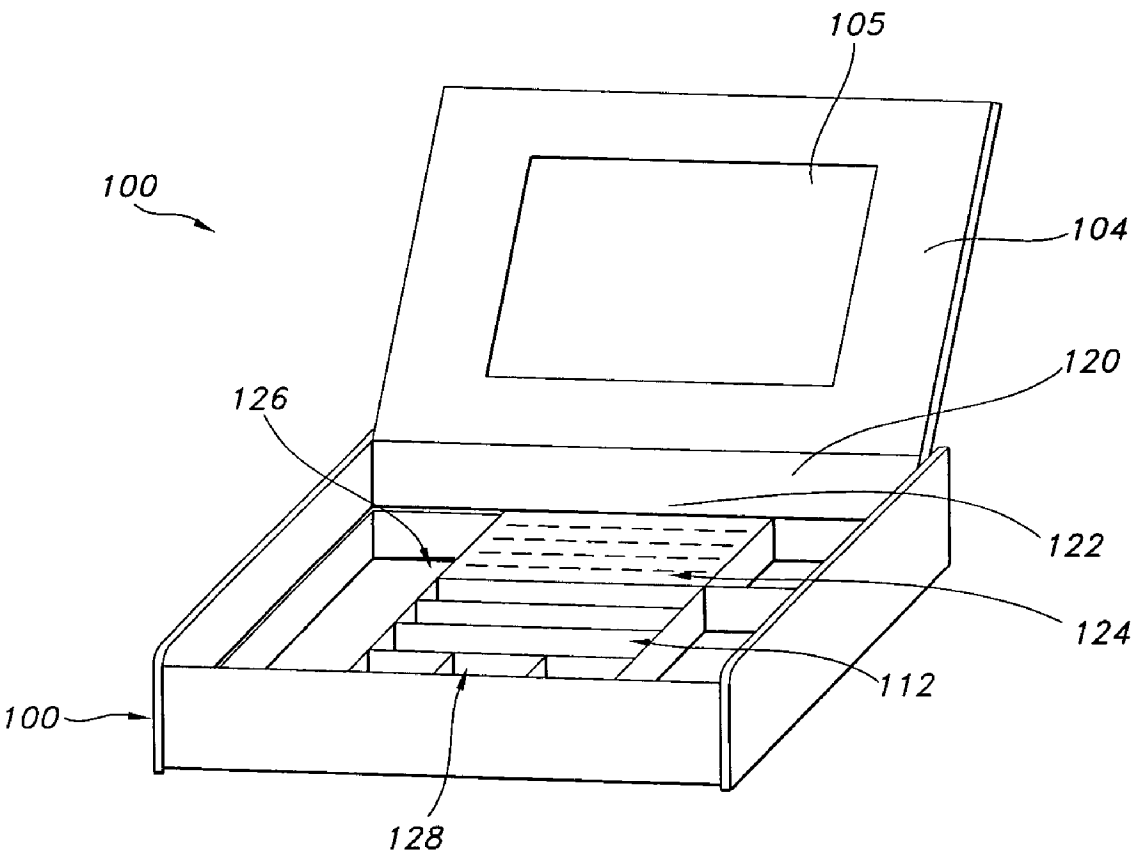
FIG. 8 is a perspective view of the jewelry box shown in FIG. 5 with the lid open and the top sliding drawer removed.

FIG. 8 is a perspective view of the jewelry box 100 shown in FIG. 5 with the top sliding tray 114 removed. As can be seen from FIG. 8, the bottom sliding tray 112 has a plurality of compartments 128 which can hold larger jewelry items such as cuff links, necklaces, etc. Next to that is a bracelet holder 124 which has a plurality of slots 126 which can accommodate bracelets therein. Located adjacent to the bracelet holder 124 is a ring holder 120. The ring holder 120 has a plurality of slots 122 which can accommodate rings therein. If the rim is formed according to FIG. 6 then, like the top sliding tray 114 shown in FIG. 5, the bottom sliding tray 112 can slide from left to right and vice versa along the bottom 106 of the base 102. If the rim is formed according to FIG. 7 then the bottom tray 112 is formed in the inner box 113 and is stationary. In FIG. 8, the lid 104 of the jewelry box 100 is shown with an optional mirror 105.

Figure 12:
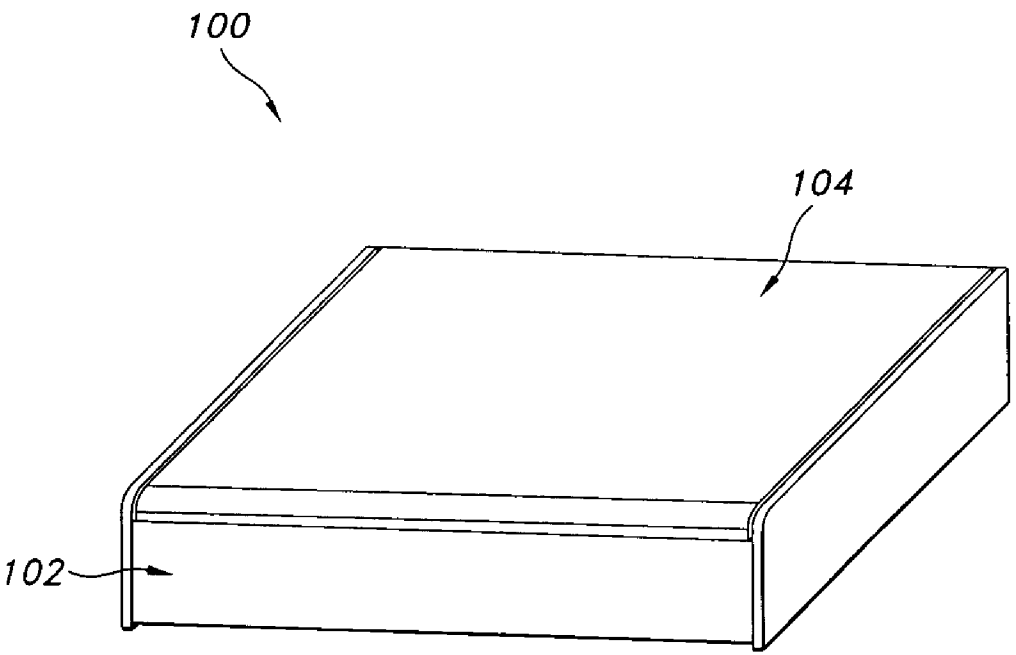
FIG. 12 is a perspective view of the jewelry box shown in FIG. 5 closed.

FIG. 12 is a perspective view of the jewelry box 100 shown in FIG. 5 with the lid closed. When the lid 104 of the jewelry box 100 is closed, it has a nice sleek design which can be placed in a drawer, put on top of a dresser, or incorporated into a closet organizer, for example. FIG. 12 is a perspective view of the jewelry box shown in FIG. 5 closed.

The jewelry box 100 shown in FIGS. 5–12 is preferably made of plastic but may be made of various materials such as acrylic, polystyrene, polypropylene and wood. The walls and floors of the compartments in the top and bottom sliding trays 112, 114 respectively and the lid 104 and bottom 106 of the box are preferably lined with the same anti-tarnish material that was described with respect to the jewelry chest shown in FIGS. 1–4. The jewelry box 100 in FIGS. 5–12 preferably has a width measured from the left side wall 110 to the right side wall 110 of about 14 inches. It has a depth measured from the front wall 108 to the back wall 108 of about 9 inches. The jewelry box has a height measured from the bottom 106 of the base 102 to the lid 104 of preferably 3 inches. Of course, those of ordinary skill in the art will realize that other dimensions may be used depending on the quantity of jewelry items that the box is designed to hold.

Figure 13:
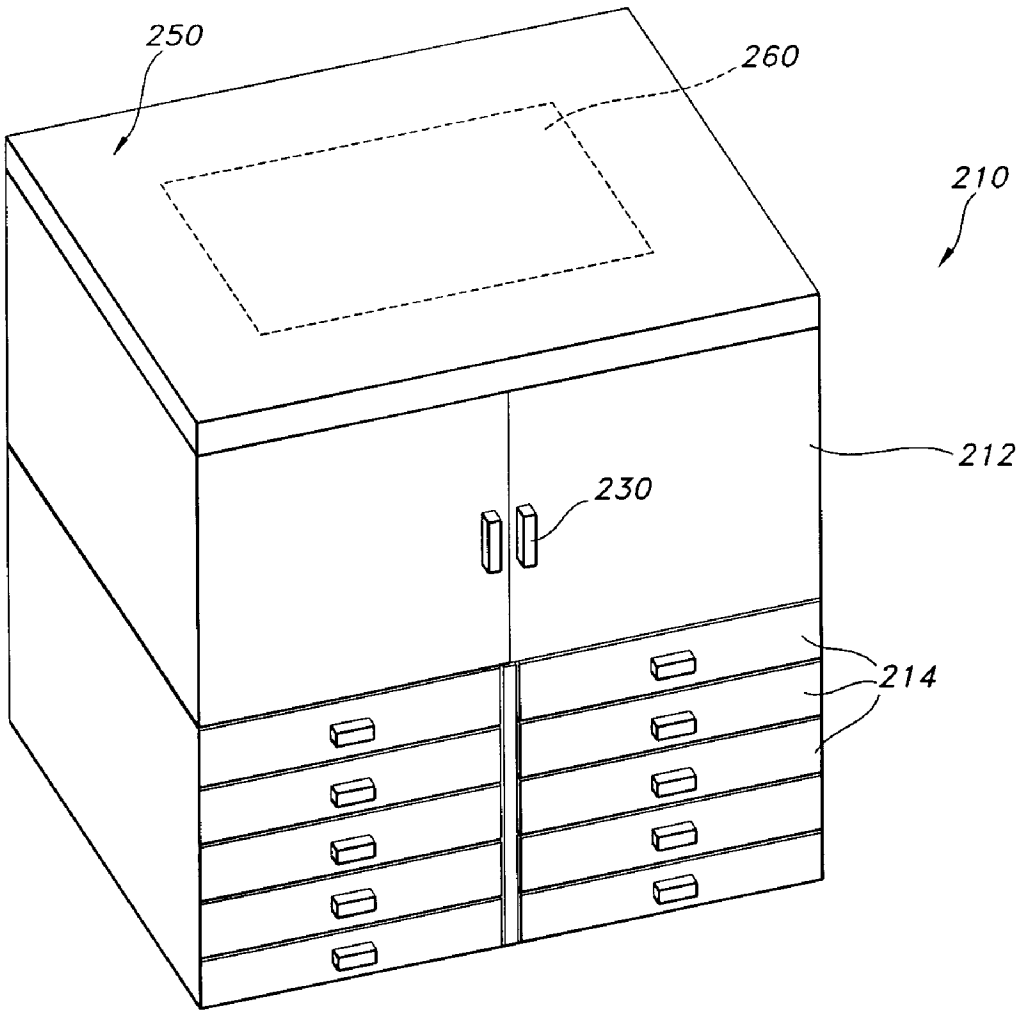
FIG. 13 is a perspective view of the jewelry chest shown in FIG. 1 with a mirror disposed thereon.

FIG. 13 is a perspective view of a jewelry chest according to another preferred embodiment of the present invention. The jewelry chest 210 is similar to that shown in FIGS. 1–4 with the exception that it includes a pivoting lid 250. Preferably on an interior surface of the lid 250 is a mirror shown in dashed lines 260. Although the mirror is shown as rectangular in shape it may have other shapes such as square, round or oval, for example.

It should be understood that a wide range of changes and modifications can be made to the embodiment described above. It is therefore intended that the foregoing description illustrates rather than limits this invention, and that it is the following claims, including all equivalents, which define the invention.

What is claimed is:

1. A chest for the storage of jewelry, the chest comprising:

a top spaced from a bottom, a first side wall opposite and spaced from a second side wall, each of the first and second side walls joining the top and bottom, and a rear wall substantially normal to the first and second side walls, wherein the top, bottom, first and second side walls and rear wall define an opening opposite the rear wall;

a first drawer slidably received in the opening;

a second drawer slidably received in the opening;

a first cabinet located between the top of the chest and the first drawer, the first cabinet including a bottom, the bottom extending in a generally horizontal plane, and a groove formed in the bottom of the cabinet; and an earring stand slidably received in the groove, the earring stand including a crosspiece extending between a pair of vertical supports, the vertical supports each extending vertically from the groove;

wherein the crosspiece is adapted to receive earrings mounted directly thereon.

2. The chest according to claim 1 wherein the first drawer houses divided compartments.

3. The chest according to claim 2 wherein the second drawer houses divided compartments.

4. The chest according to claim 1 wherein the first drawer houses a ring section.

5. The chest according to claim 1 wherein the crosspiece includes a plurality of pierced earring holes.

6. The chest according to claim 1 wherein the chest is constructed of plastic, acrylic, polystyrene, polypropylene or wood.

7. The chest according to claim 1 further comprising a first storage compartment unit that is removably placed in the first drawer.

8. The chest according to claim 1 wherein at least one of the first and second drawers is lined with antitarnish cloth.

9. The chest according to claim 1 wherein the first cabinet is rotatably secured to the chest in proximity to the rear wall.

* * * * *